US006411286B2

(12) United States Patent
Vassigh et al.

(10) Patent No.: US 6,411,286 B2
(45) **Date of Patent: *Jun. 25, 2002**

(54) DYNAMIC KEY TERMINAL INCLUDING CHOICE-DRIVEN INTERFACE

(75) Inventors: Ali M. Vassigh, Lawrenceville; David M. Rubini, Atlanta; Michael T. Inderrieden; Lynn B. Miller, both of Lawrenceville, all of GA (US)

(73) Assignee: NCR Corporation, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/801,380

(22) Filed: Mar. 7, 2001

Related U.S. Application Data

(63) Continuation of application No. 08/269,703, filed on Jul. 1, 1994, now Pat. No. 6,225,982.

(51) Int. Cl.[7] ..... G09G 5/00
(52) U.S. Cl. ..... 345/173; 345/168
(58) Field of Search ..... 345/173, 174, 345/175, 176, 177, 178, 168, 169; 178/18.01, 18.05, 18.1, 19.01, 19.04; 705/25

(56) References Cited

U.S. PATENT DOCUMENTS

| | | | | |
|---|---|---|---|---|
| 4,752,874 A | | 6/1988 | Meyers | 364/405 |
| 4,893,237 A | | 1/1990 | Unno | 364/405 |
| 5,063,600 A | | 11/1991 | Norwood | 382/13 |
| 5,122,787 A | | 6/1992 | Fujita et al. | 340/712 |
| 5,297,030 A | | 3/1994 | Vassigh et al. | 304/405 |
| 5,302,811 A | | 4/1994 | Fukatsu | 235/381 |
| 6,225,982 B1 | * | 5/2001 | Vassigh et al. | 345/173 |

* cited by examiner

*Primary Examiner*—Xiao Wu
(74) *Attorney, Agent, or Firm*—Paul W. Martin; Priest & Goldstein, PLLC

(57) ABSTRACT

A dynamic key terminal including a choice-driven interface which employs multi-pathing to guide a retail operator through a retail transaction. A display displays choices vertically on one side of the display to an operator. A first keypad, vertically oriented in the front surface of the housing adjacent the choices displayed by the display, is used by an operator for entering choices. A second keypad adjacent the first keypad is used by the operator to enter item information. The terminal may also have a card reader. A processor controls operation of the terminal and executes a graphic user interface including a plurality of overlays wherein each overlay is associated with a choice selected by the operator using the first keypad. A method for guiding an operator through a retail transaction is also disclosed, wherein each user choice causes the processor to display an overlay specific to the choice entered.

9 Claims, 19 Drawing Sheets

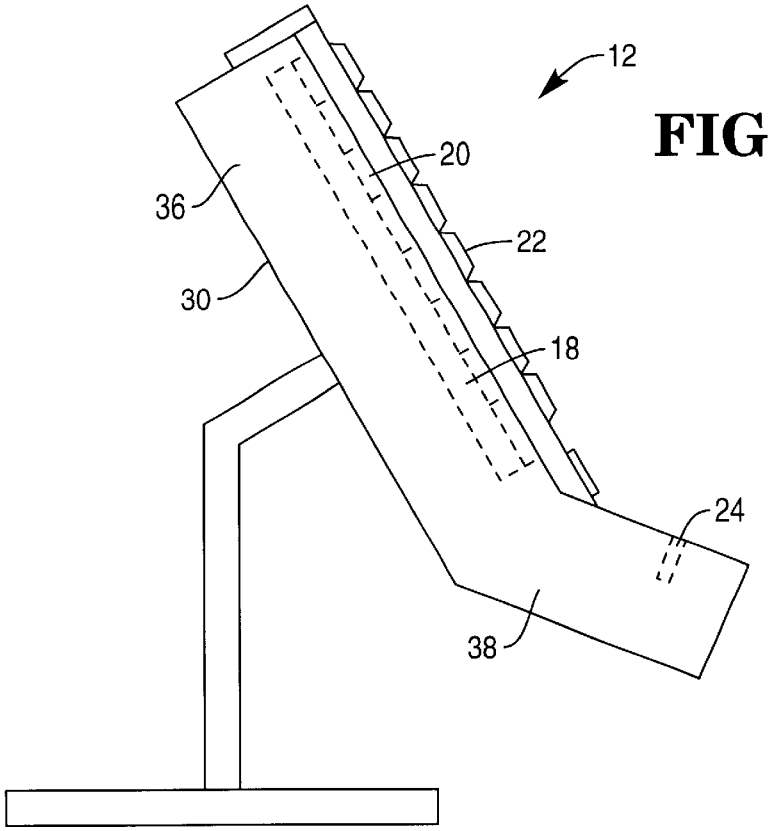
FIG. 4
FIG. 5
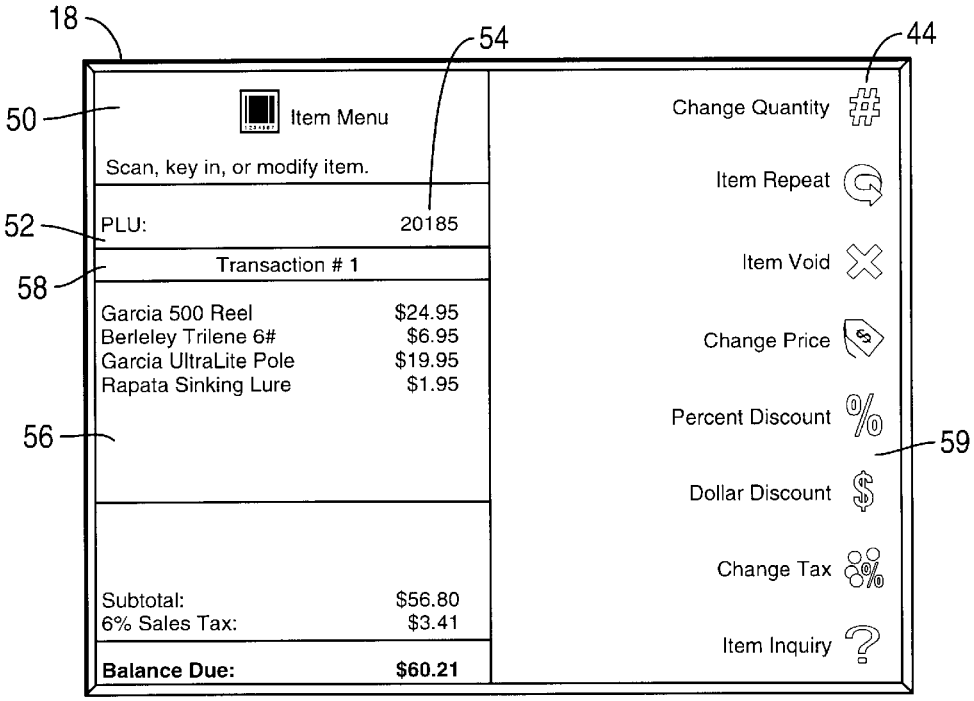

DYNAMIC KEY TERMINAL INCLUDING CHOICE-DRIVEN INTERFACE

This application is a continuation of Ser. No. 08/269,703, filed Jul. 1, 1994 now U.S. Pat. No. 6,225,982.

BACKGROUND OF THE INVENTION

The present invention relates to retail terminals and more specifically to a dynamic key terminal including a choice-driven interface.

Within the retail environment, operation of current terminals by employees is not intuitive. Employees must receive training and use the terminals for a predetermined amount of time in order to become proficient at operating the terminals. Inexperienced operators cause delays in the checking lines and are prone to making mistakes.

Therefore, it would be desirable to provide an input terminal and an interface that are intuitive for inexperienced employees to operate and which reduces the likelihood of errors by employees.

SUMMARY OF THE INVENTION

In accordance with the teachings of the present invention, a dynamic key terminal including a choice-driven interface is provided. A display displays choices vertically on one side of the display to an operator. A first keypad, vertically oriented in the front surface of the housing adjacent the choices displayed by the display, is used by an operator for entering choices. A second keypad adjacent the first keypad is used by the operator to enter item information. The terminal may also have a card reader. A processor controls operation of the terminal and executes a graphic user interface including a plurality of overlays wherein each overlay is associated with a choice selected by the operator using the first keypad.

A method for guiding an operator through a retail transaction is also disclosed. The method employs multi-pathing as a tool to complete a transaction. Multi-pathing may be defined as providing a plurality of ways to accomplish the same function. The present invention employs the choice-driven actuators and the keypad to accomplish multi-pathing. For example, if the choice is to modify an item entry, the possible ways to modify an item entry may include various combinations of actuator and keypad entries.

The method begins with the processor displaying a first overlay of the choice-driven interface, which contains a choice to enter information about an item to be purchased by a customer. The processor records the information entered by the operator. The processor displays the item information as part of the first overlay. The processor displays additional choices for modifying the item information as part of the first overlay. The processor displays a second overlay containing payment choices. Finally, the processor records the payment choice entered by the operator through a keypad adjacent the choices.

Additional steps may include displaying a third overlay containing payment amount choices and total cost information by the processor, recording a payment amount choice entered by the operator through the keypad adjacent the choices, and displaying a fourth overlay containing a representation of change information, if the payment amount choice is more than the total cost, by the processor.

The method also includes steps for displaying an overlay on a retail terminal, including the steps of establishing left and right portions of the overlay; providing operator choices within the right portion of the overlay; displaying the operator choices; establishing top, middle, and bottom areas within the left portion of the overlay; providing overlay title information within the top portion of the overlay; providing an item list within the middle portion of the overlay; providing payment information within the bottom portion of the overlay; and displaying the top, middle, and bottom portions.

It is a feature of the present invention that the keys with the keypad associated with the choices displayed in the choice-driven interface change their functions as the overlays change.

It is accordingly an object of the present invention to provide a dynamic key terminal including a choice-driven interface.

It is another object of the present invention to provide a dynamic key terminal including a choice-driven interface which is intuitive to use and which guides an operator through a retail transaction with minimal supervisor intervention.

It is another object of the present invention to provide a dynamic key terminal including a choice-driven interface which includes a plurality of overlays wherein each overlay includes choices that are recorded by an operator using a keypad adjacent the choices.

It is another object of the present invention to provide a dynamic key terminal which includes a display for displaying a choice-driven interface, a plurality of choice buttons adjacent the display, and a keypad, all within a housing that has a small footprint on the checkout counter.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

FIG. 4 is a side view of the dynamic key terminal of the present invention;

FIG. 5 is a view of the display of the dynamic key terminal illustrating the functional sections of the choice-driven interface;

DETAILED DESCRIPTION OF THE PREFERRED EMBODIMENT

Figure 1:
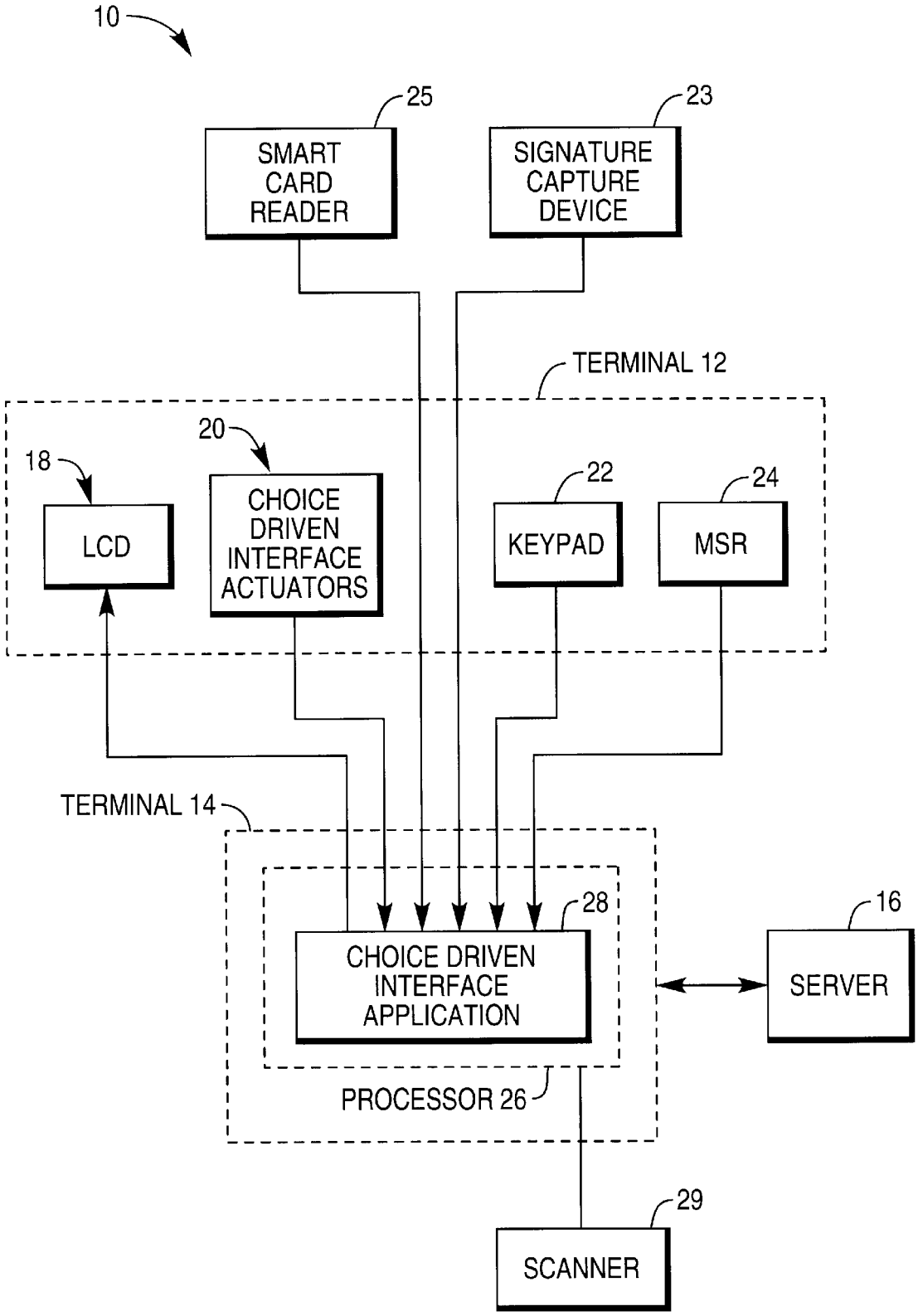
FIG. 1 is a block diagram of the dynamic key terminal of the present invention.

Referring now to FIG. 1, system 10 includes dynamic key terminal 12 and terminal 14. In a network environment, system 10 also includes server 16.

Terminal 12 includes liquid crystal display (LCD) 18, choice-driven interface actuators 20, and keypad 22. In a first embodiment (FIG. 2), choice-driven interface actuators 20 are mechanical buttons 35. In a second embodiment (FIG. 3), choice-driven interface actuators 20 are touch sensitive screen portions 37 within LCD 18. Terminal 12 may also include other peripheral devices in the same housing such as magnetic stripe reader 24.

LCD 18 displays the choice-driven interface.

Choice-driven interface actuators 20 enter user inputs corresponding to displayed interface choices. Actuators 20 record user choices in response to instructions and choice queries displayed by LCD 18. The functions associated with actuators 20 change and are specific to each overlay generated by choice-driven interface application program 28.

Keypad 22 provides keys, numerical keys and other standard retail function keys. Keypad 22 may be used to implement any of the functional choices displayed by choice driven interface 28, either alone or in combination with actuators 20, thereby providing a plurality of ways to accomplish the same function. This concept, called multi-pathing, is employed throughout the present invention.

MSR 24 reads magnetic stripes on credit and debit cards.

Terminal 14 includes processor 26 which executes choice-driven interface application program 28. Thus, terminal 12 cannot be operated without terminal 14 Processor 26 responds to user inputs from actuators 20, keypad 22, and MSR 24 by displaying instruction and choice query overlays generated by application program 28.

Choice-driven interface application program 28 provides a graphic interface for executing known terminal functions. Choice-driven interface application program 28 may be implemented to run in a Microsoft Disk Operating System (DOS) or Windows environment.

Server 16 stores application program 28 and makes it available for loading by terminal 14.

Scanner 29 provides item information to processor 26.

Terminal 12 may also include ports for connecting additional peripherals, including signature capture device 23 and SMART card reader 25.

Figure 2:
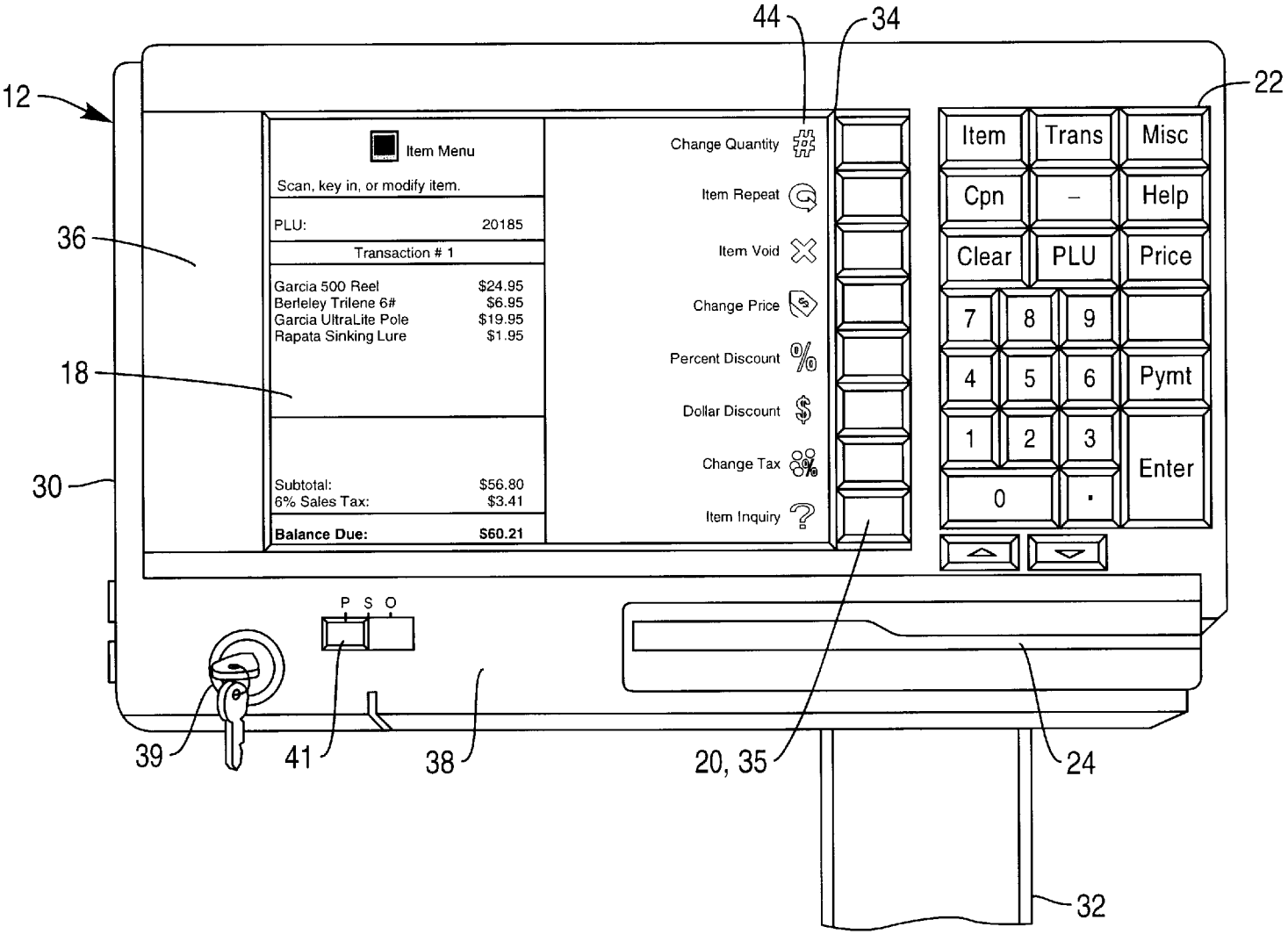
FIG. 2 is front view of the dynamic key terminal of the present invention.
Figure 3:
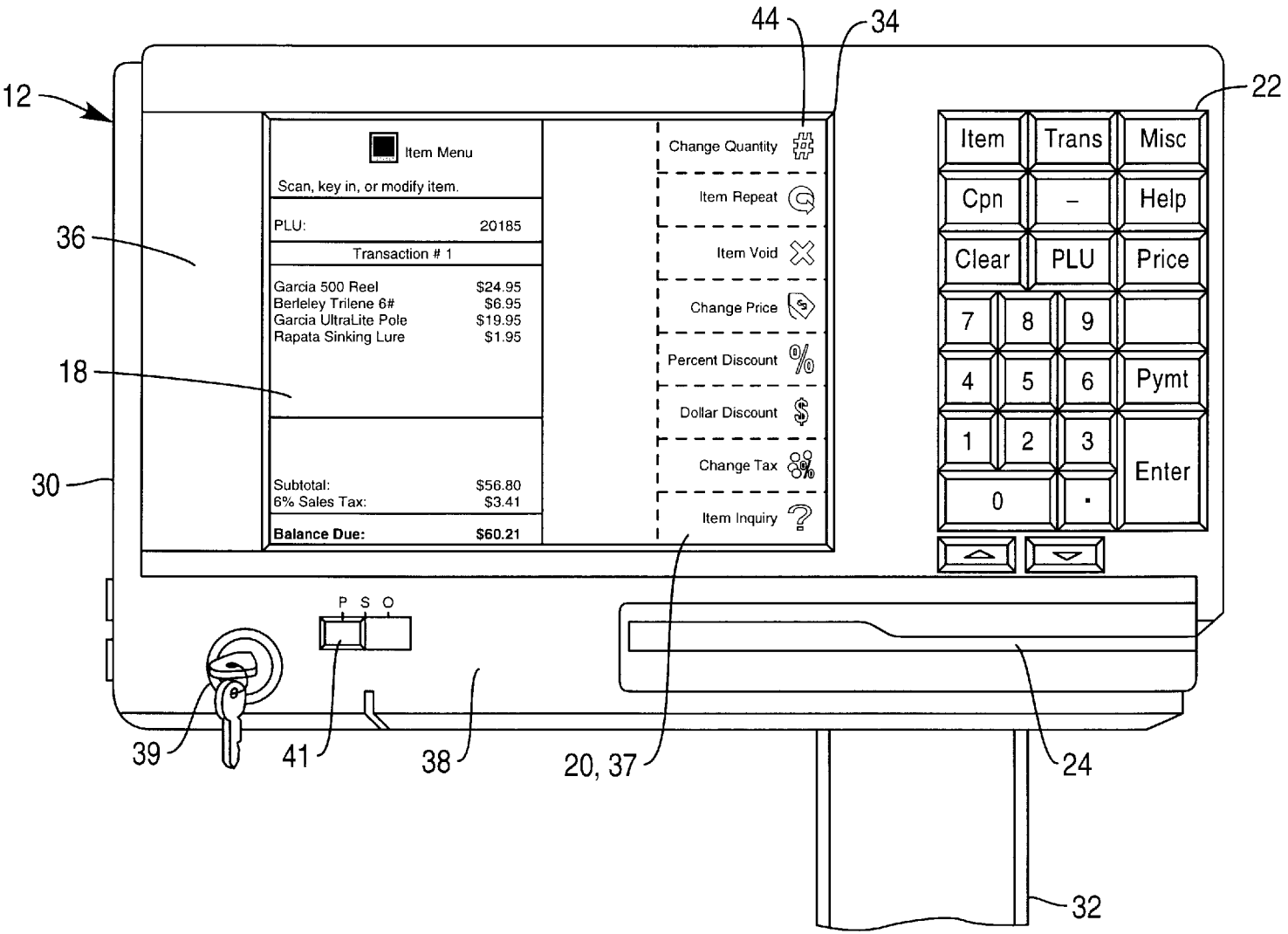
FIG. 3 is front view of another embodiment of the dynamic key terminal of the present invention.

Turning now to FIGS. 2–4, terminal 12 is shown in more detail. Terminal 12 includes housing 30 and housing support stand 32.

Housing 30 includes a display and input portion 36 and an MSR portion 38. Display and input portion is generally rectangular in shape and includes LCD 18, actuators 20, and keypad 22. MSR portion 38 is inclined slightly towards an operator and contains MSR 24 (FIG. 4).

Use of LCD 18 allows housing 30 to be lightweight and slender. Components 18-24 are organized within housing 30 in accordance with recommendations from human factors research which provided the most ergonomic and user-friendly locations. Keypad 22 is rectangular in shape and is arranged vertically. MSR 24 is located horizontally in MSR portion 38. LCD 18 is located on the side opposite keypad 22. Actuators 20 are vertically arranged one over the other along one side 34 of LCD 18.

With reference to FIG. 2, mechanical choice buttons 35 are arranged vertically adjacent corresponding choices 44 displayed by LCD 18.

With reference to FIG. 3, touch screen actuators 37 overlap displayed choices 44.

Stand 32 supports terminal 12 above checkout counter, typically behind scanner within checkout counter and facing the operator. Stand 32 also provides a conduit for wiring between terminal 12 and terminal 14, which is located within checkout counter. Terminal 12 may be rotated about stand 32 for operator comfort.

Key lock 39 allows terminal 12 to be secured from unauthorized use.

Power/standby switch 41 has three positions, "P" for "On", "S" for "Standby", and "O" for "Off". The standby position places terminals 12 and 14 into a low-power mode.

Turning now to FIGS. 5–19, the choice-driven interface of the present invention is illustrated. With reference to FIG. 5, choice-driven interface application program 28 creates a graphic interface which divides LCD 18 into functional sections.

Title and instruction section 50 in the upper left corner of LCD 18 displays the title of the overlay and any instructions.

Prompt section 52 displays prompts for information.

Echo section 54 is adjacent prompt section 52 and displays responses entered by an operator.

List section 56 is in the lower left hand corner and is used to display lists of merchandise items entered through keypad 22 or scanner 29.

List caption section 58 contains information about the number of items displayed in list section 56.

Options section 59 occupies the entire right half of LCD 18 and displays user-driven interface choices 44.

Figure 6A:
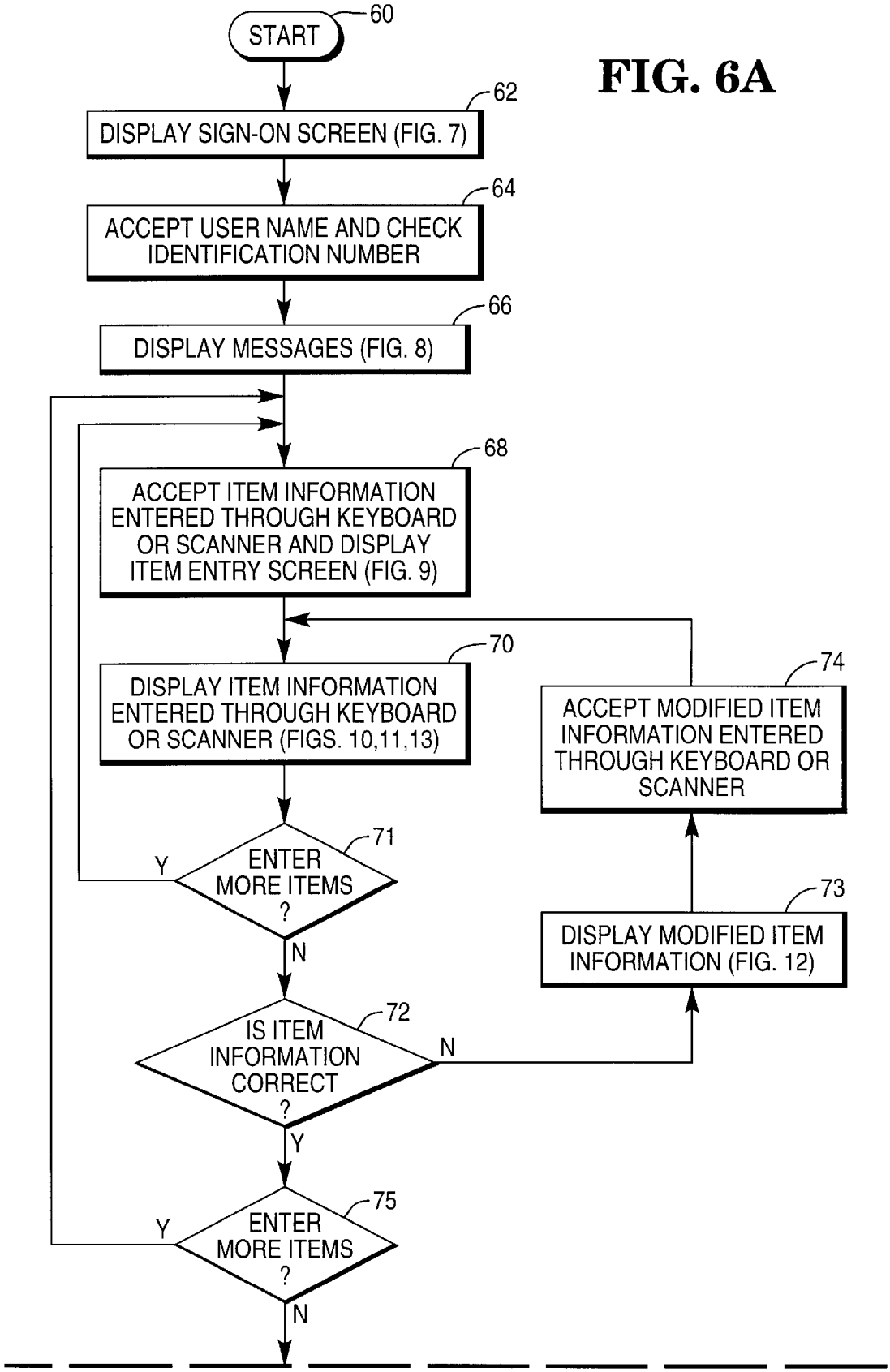
FIGS. 6A and 6B form a flow diagram illustrating the operation of the choice-driven interface in connection with a retail transaction.
Figure 6B:
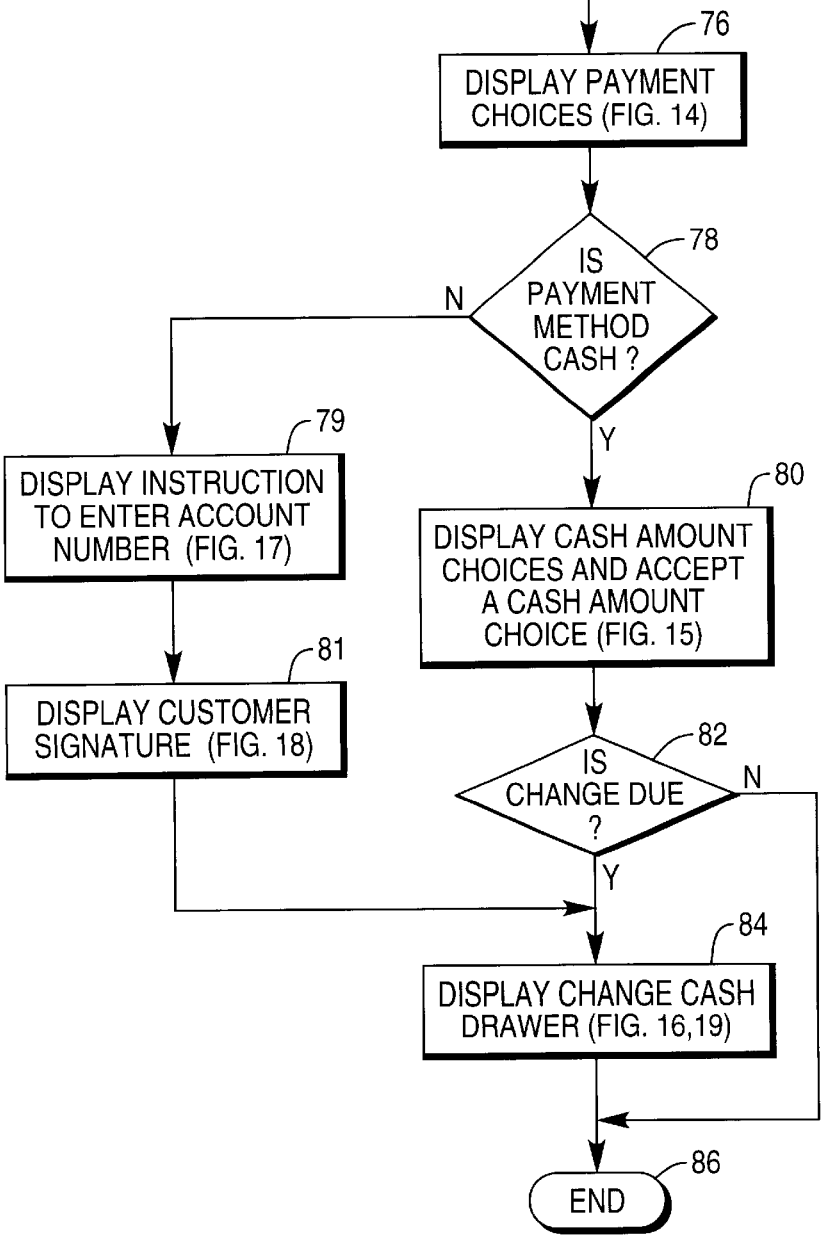
Figure 7:
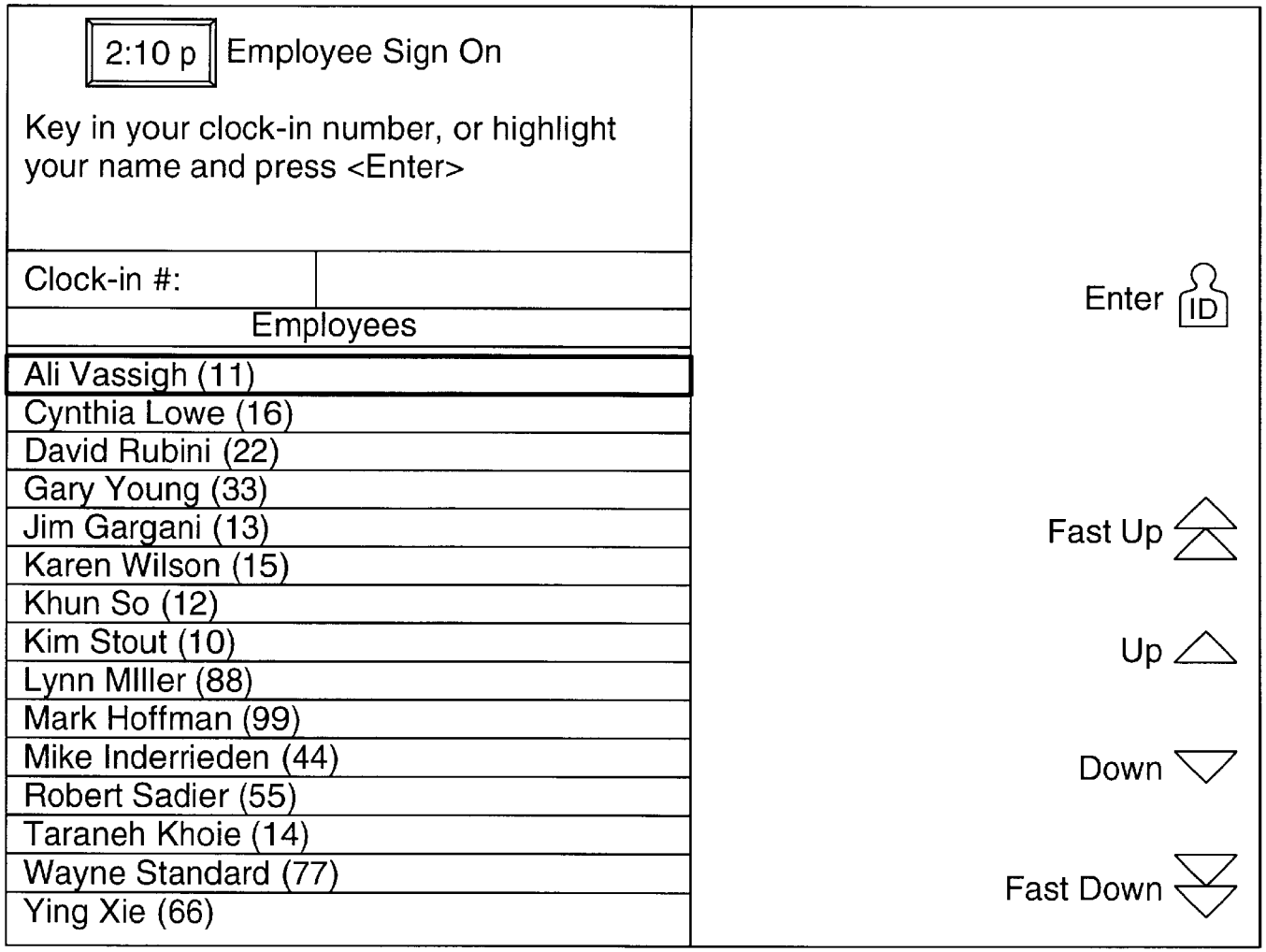
FIG. 7 is a view of an overlay of the choice-driven interface.
Figure 8:
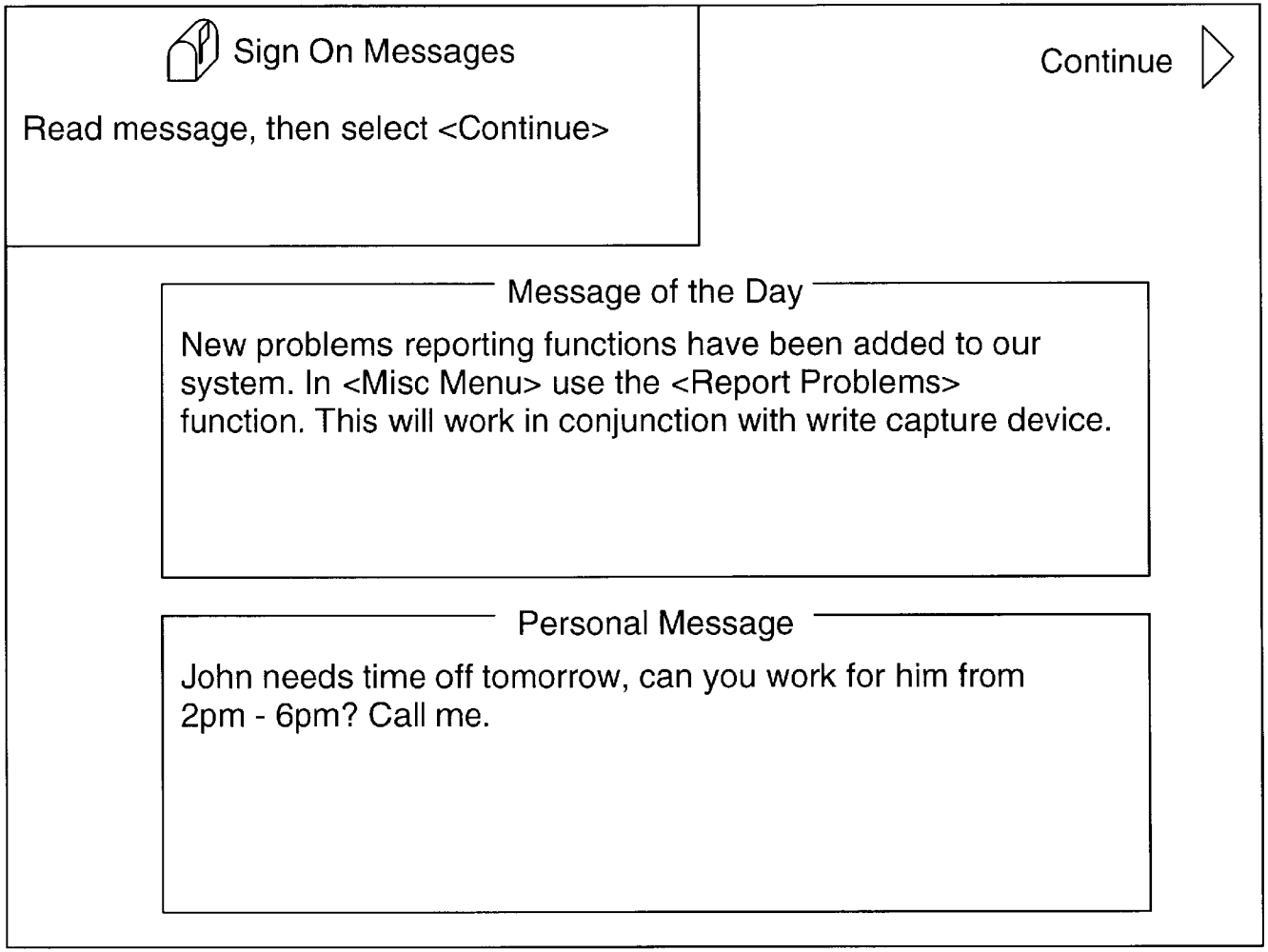
FIG. 8 is a view of another overlay of the choice-driven interface.
Figure 9:
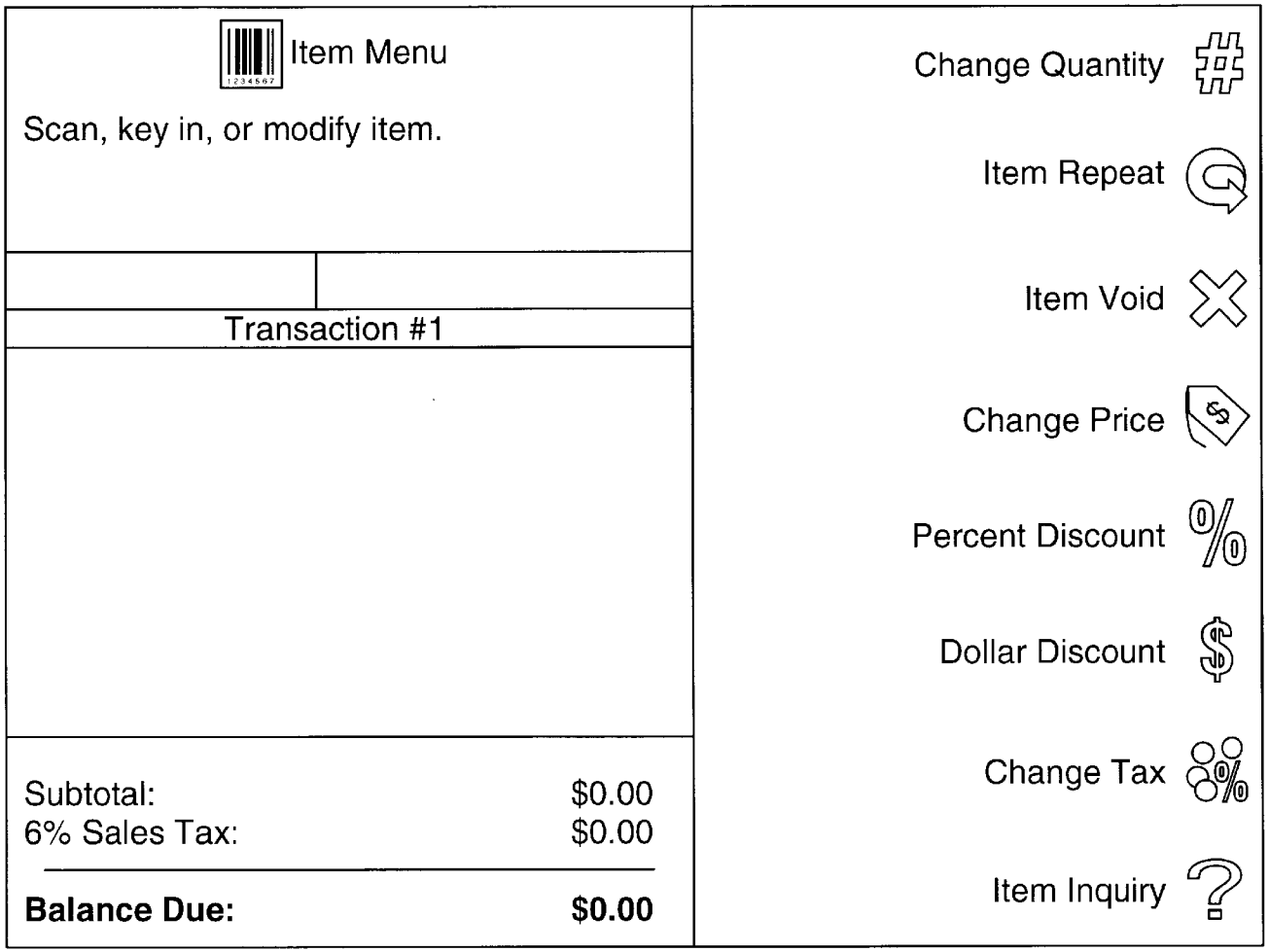
FIG. 9 is a view of another overlay of the choice-driven interface.
Figure 10:
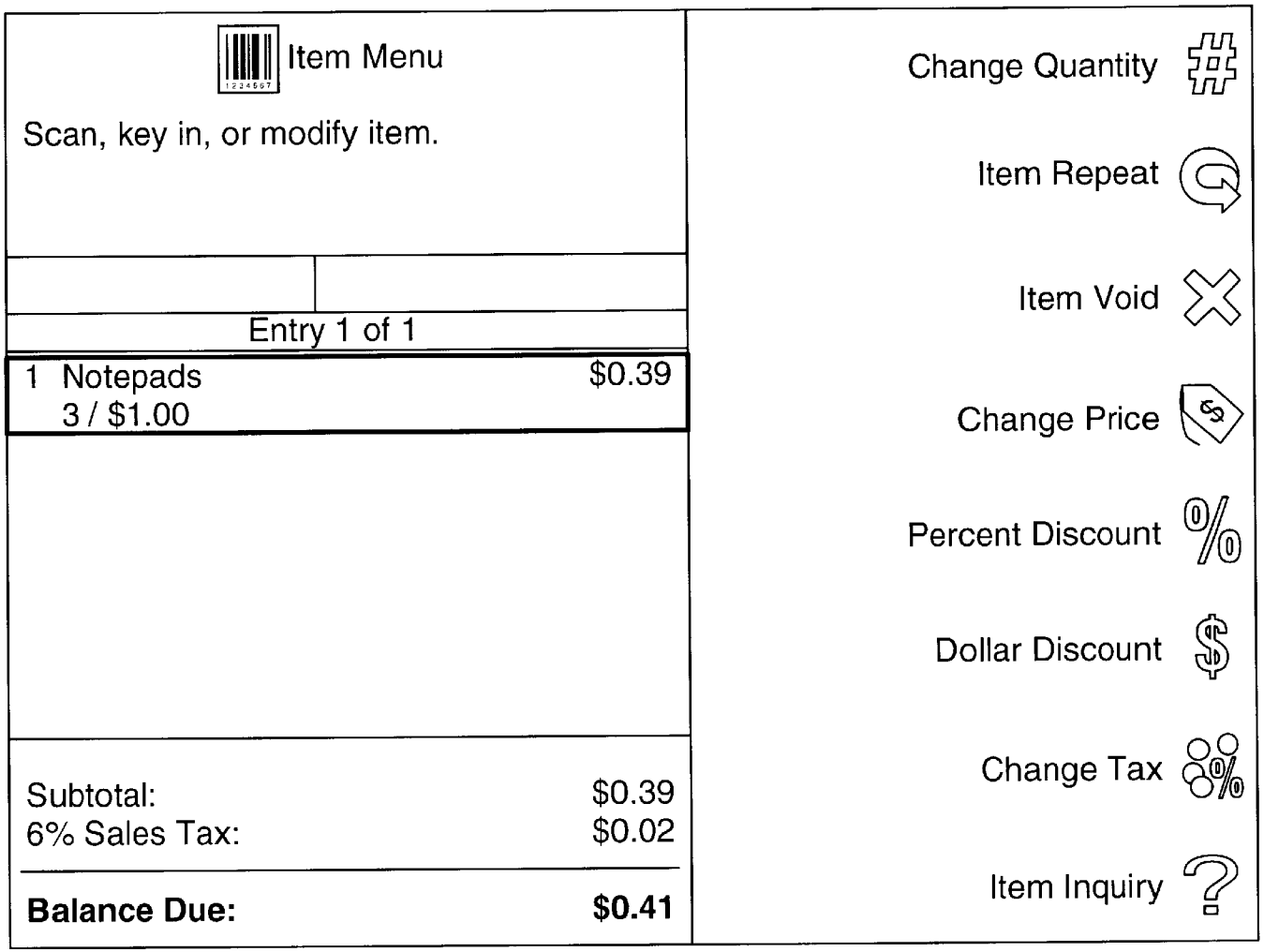
FIG. 10 is a view of another overlay of the choice-driven interface.

Referring now to FIGS. 6A and 6B, a flow diagram illustrating a typical sequence of interface choices is shown beginning with START 60. Each step follows the next and takes an operator through a specific sequence of overlays based upon the choice entered by the operator.

In step 62 (FIG. 7), choice-driven interface application program 28 displays a list of user names and an "Enter ID" choice on the right. Scroll up and down choices are also displayed.

In step 64, choice-driven interface application program 28 accepts a proper name entered by the user from the list, a user identification number entered by the user, and checks the identification number, all after the user selects the "Enter ID" choice. Choice-driven interface application program 28 also records the time of day in order to keep an electronic record of the operator's working hours.

In step 66 (FIG. 8), choice-driven interface application program 28 displays broadcast and other messages of interest to the operator.

In step 68, choice-driven interface application program 28 displays an item entry overlay (FIG. 9) and accepts item information, such as a price look-up number, entered through keypad 22 or scanner 29.

In step 70 (FIG. 10), choice-driven interface application program 28 displays the item information entered in step 68. Choice-driven interface application program 28 offers choices along the right side to modify any item that has been entered. The choices include "Change Quantity", "Item Repeat", "Change Price", "Item Void", "Make Non-Discountable", "Change Tax", "Make Food-stampable", and "Item Inquiry". The item to be modified may be chosen by moving cursor keys on the keypad 22.

Figure 11:
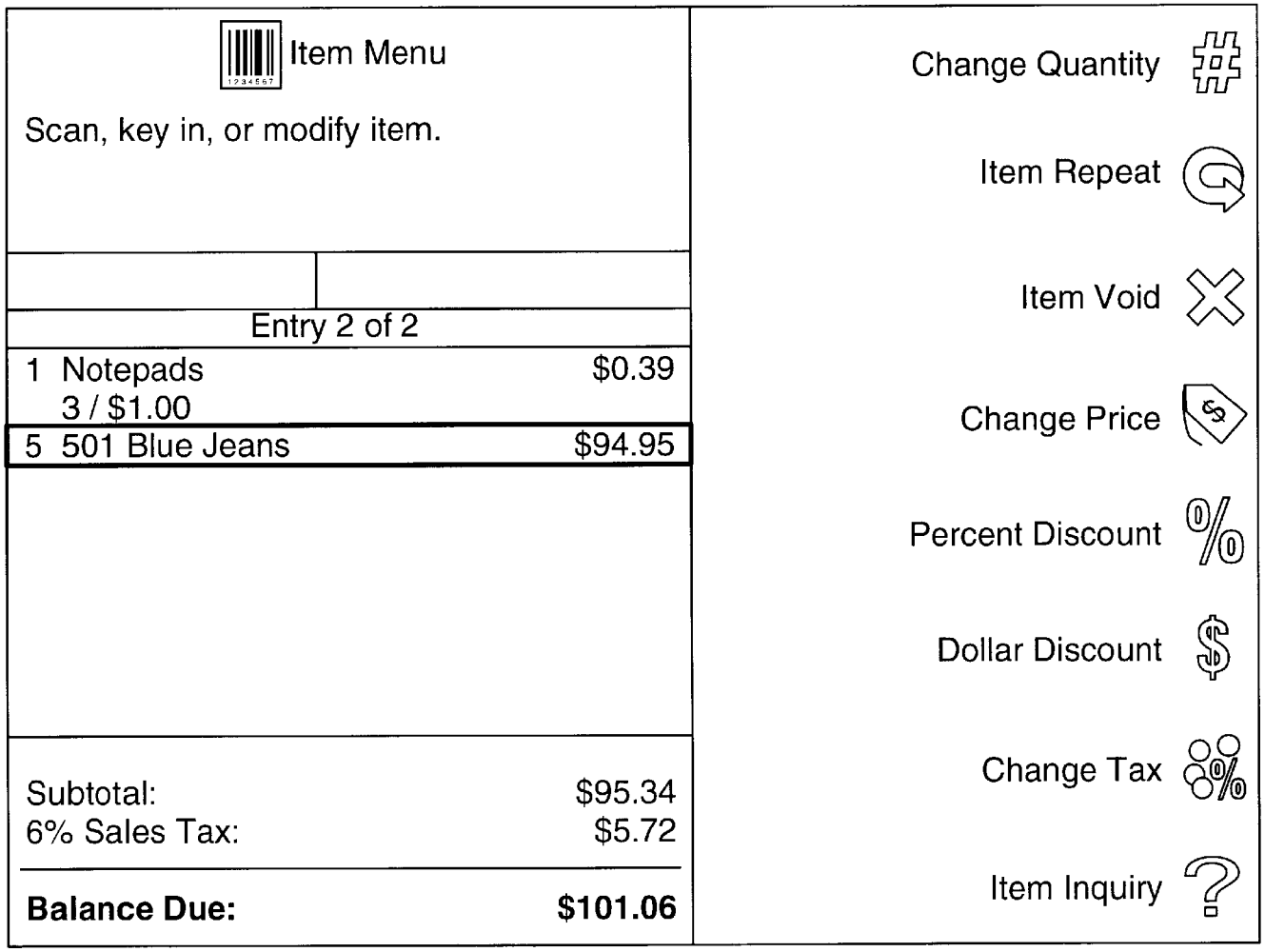
FIG. 11 is a view of another overlay of the choice-driven interface.

In step 71, determines whether more items are to be entered. If so, the method loops back to step 68. If not, the method proceeds to step 72. FIG. 11 illustrates the items entry overlay of FIG. 10 after a second item has been entered.

Figure 12:
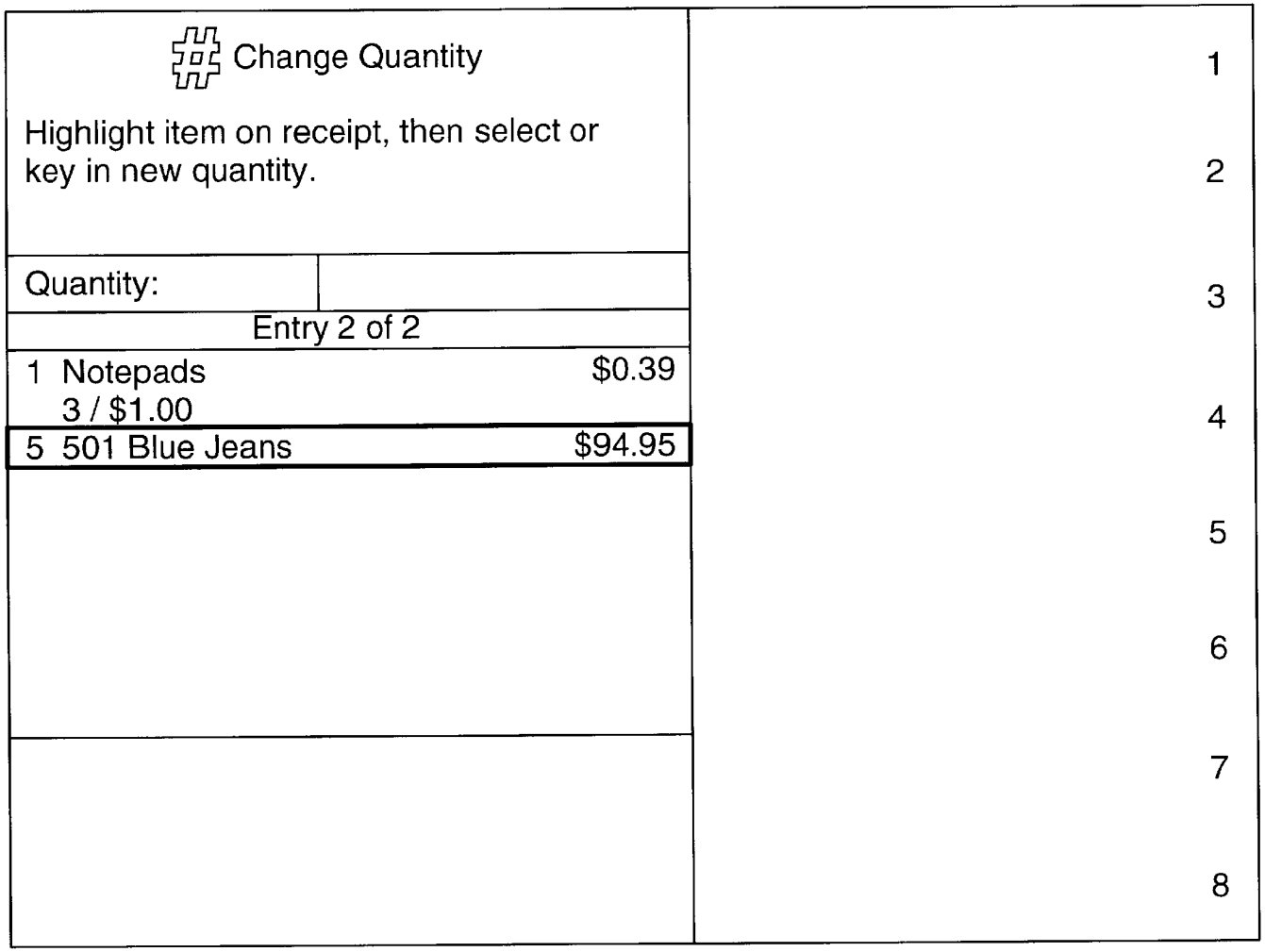
FIG. 12 is a view of another overlay of the choice-driven interface.

In step 72, choice-driven interface application program 28 determines whether a modification choice has been entered by a user. If so, it displays additional overlays, based upon the modification choice of the user in step 73. FIG. 12 illustrates the case in which a user selects the "Change Quantity" choice in FIG. 11 to change the number of blue jeans purchased. The "Change Quantity" choice produces further choices along the right side for likely numbers of blue jeans to be purchased, from 1 to 8. The number may also be entered manually using keypad 22. Other modification choices are made in a similar way.

The item modification process of step 72 illustrates the concept of multi-pathing, which is used throughout the choice-driven interface of the present invention. An operator function may be performed in a plurality of different ways, using actuators 20 and keypad 22. For example, item modification may be performed by engaging a number key within keypad 22, followed by the quantity actuator. Or, item modification may be performed by engaging the quantity actuator, followed by the number actuator. Or, item modification may be performed by engaging the quantity actuator, followed by the number key within keypad 22, followed by the "Enter" key of keypad 22. Finally, item modification may be performed by engaging the "Repeat" key a number of items equal to the number of items less one time.

Figure 13:
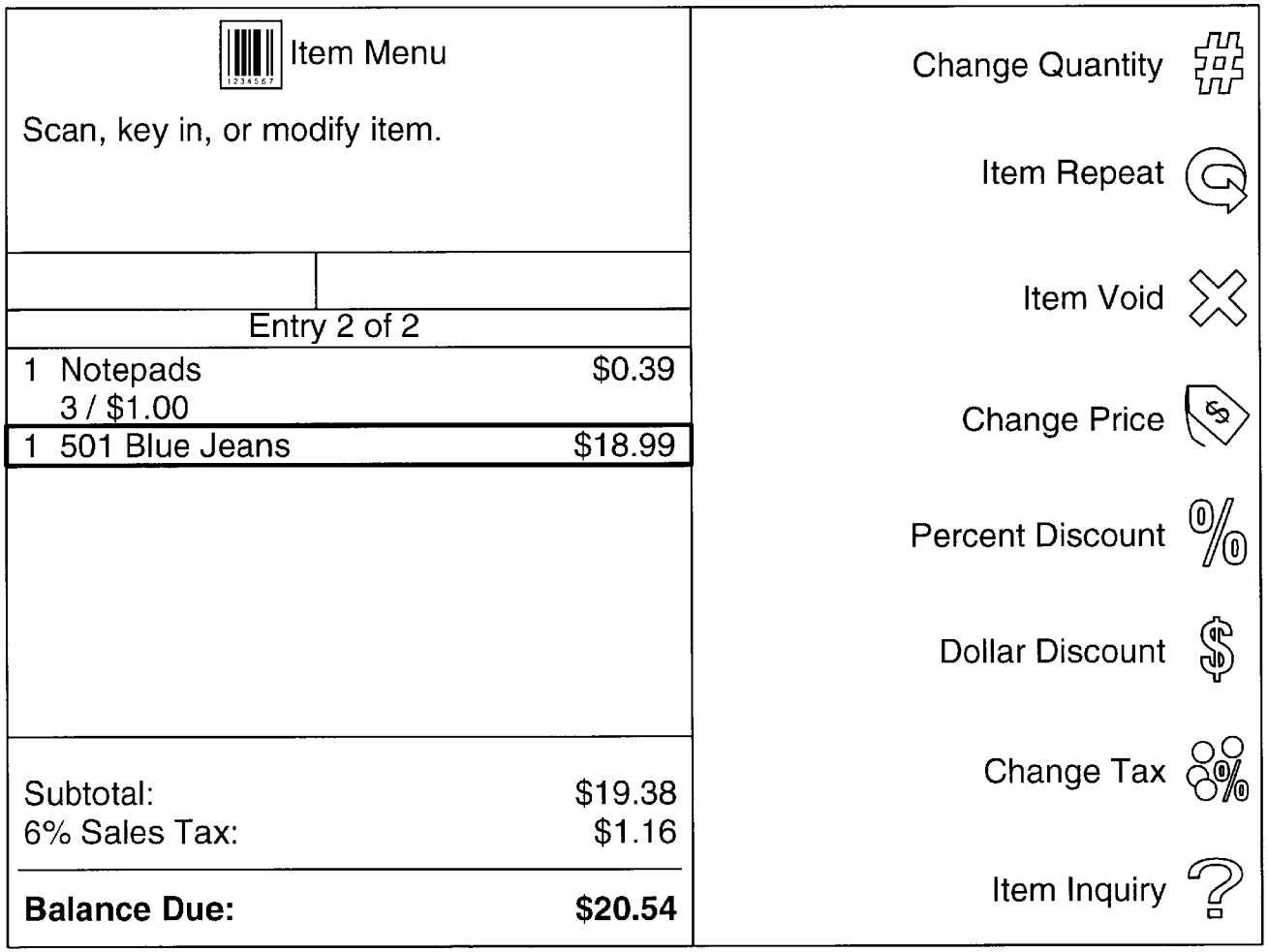
FIG. 13 is a view of another overlay of the choice-driven interface.

In step 74, choice-driven interface application program 28 accepts the modification by the user and returns to step 70 in which choice-driven interface application program 28 displays the item as modified. Here the item entry overlay of FIG. 13 shows a new quantity of blue jeans.

After an item is modified, the method returns to step 71, in which more items may be entered. Alternatively, the method may proceed again to step 72 for further modifications. If there are no further modifications necessary, the method proceeds to step 75 for more item entries. If there are no further item entries or modifications, the method proceeds to the payment process, beginning with step 76.

Figure 14:
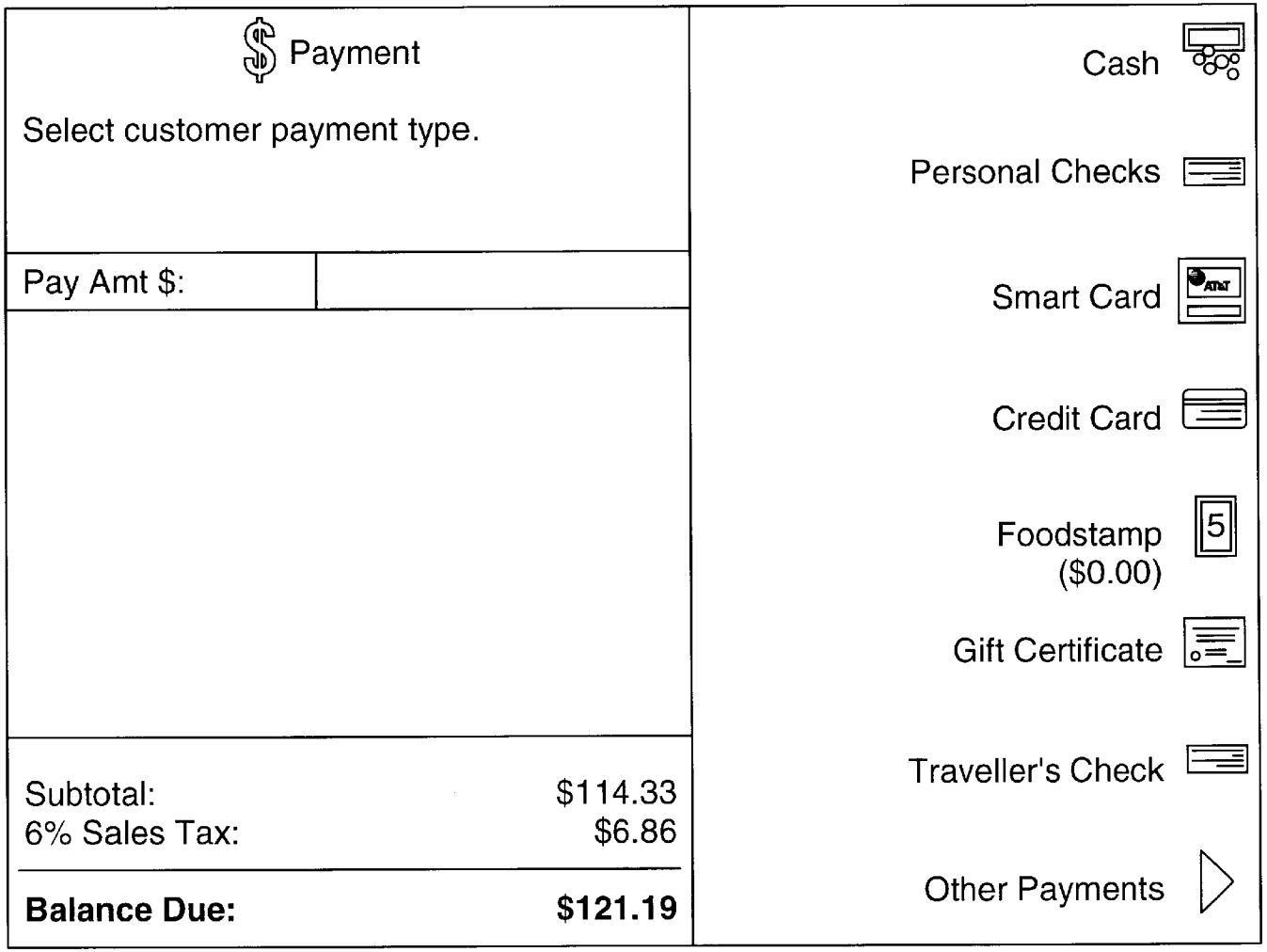
FIG. 14 is a view of another overlay of the choice-driven interface.
Figure 15:
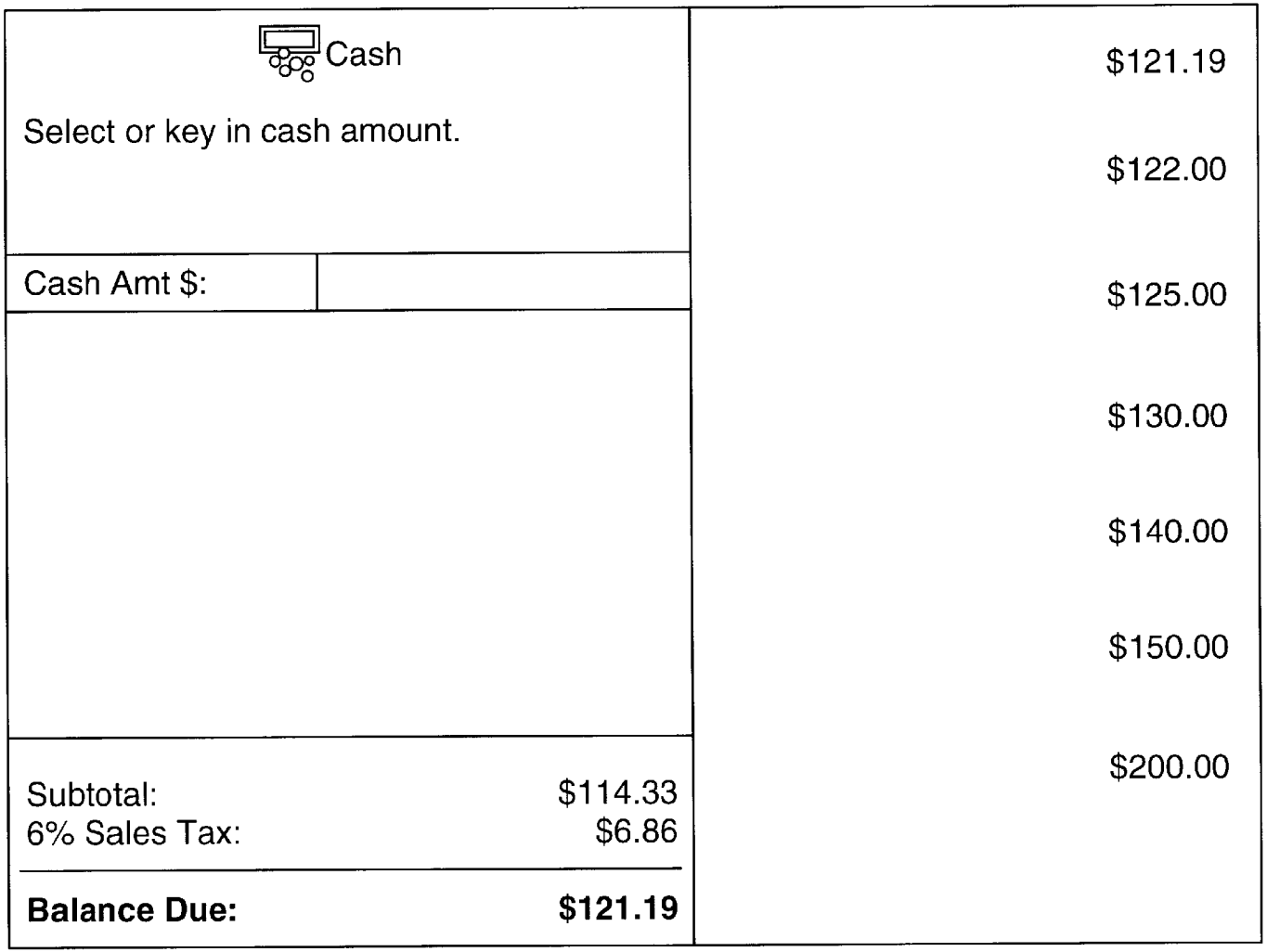
FIG. 15 is a view of another overlay of the choice-driven interface.

In step 76, choice-driven interface application program 28 displays predetermined payment options (FIG. 14). Here, the options include "Cash", "Personal Checks", "Credit Card", "Smart Card", "Food Stamp", "Gift Certificate", "Traveler's Check", or other forms of payment.

In step 78, the method is simplified to reflect only the choices of "Cash" and "Credit Card". Thus, the method determines whether the payment option is cash. If so, the method proceeds to step 80 (FIG. 15) in which choice-driven interface application program 28 displays predetermined payment options and accepts a choice entry by the operator based upon a choice by the customer. The payment choices for cash include exact change and additional combinations of paper currency that exceed the total price. The user may also manually enter the paid amount using keypad 22.

Figure 16:
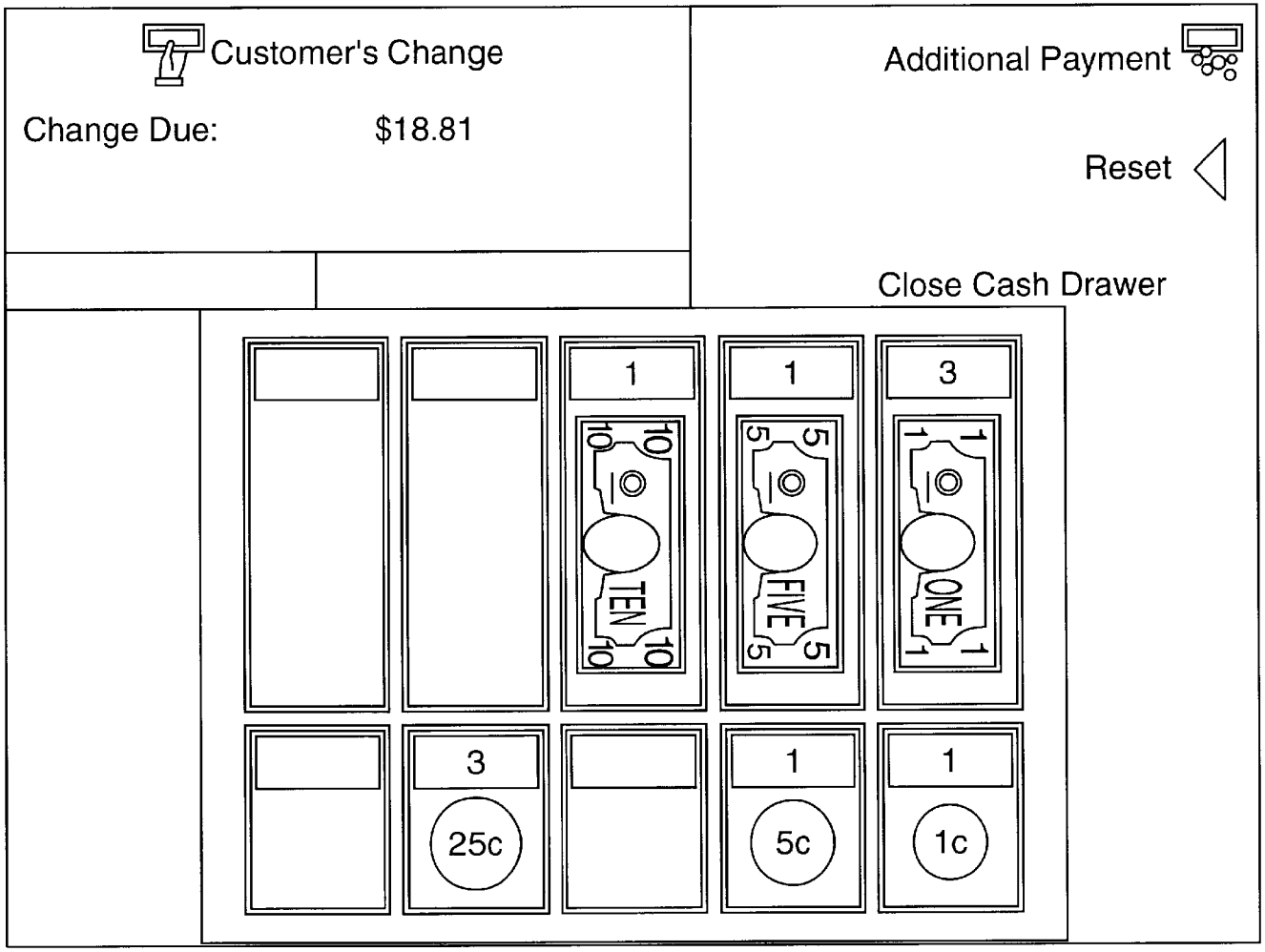
FIG. 16 is a view of another overlay of the choice-driven interface.
Figure 17:
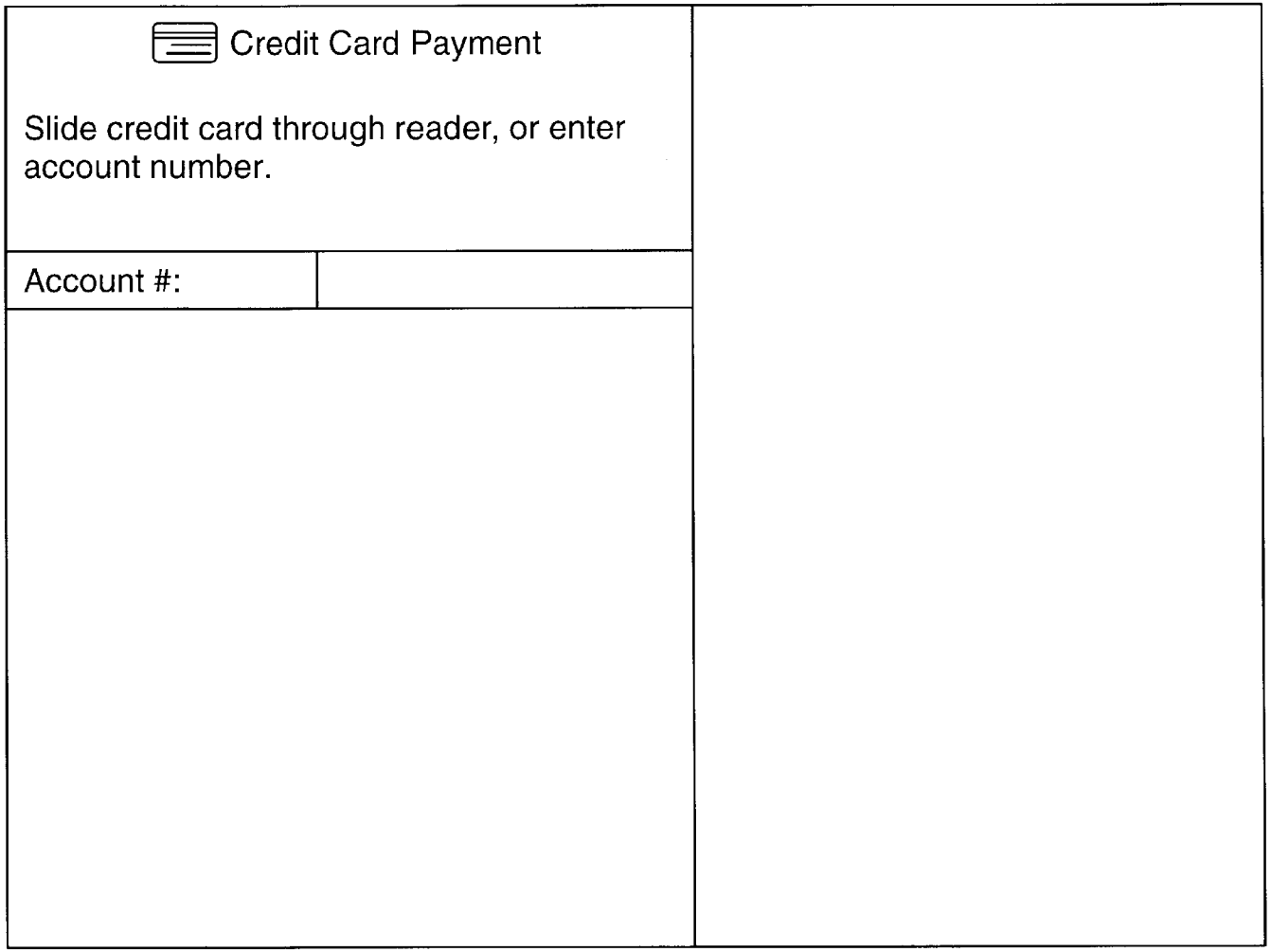
FIG. 17 is a view of another overlay of the choice-driven interface.
Figure 18:
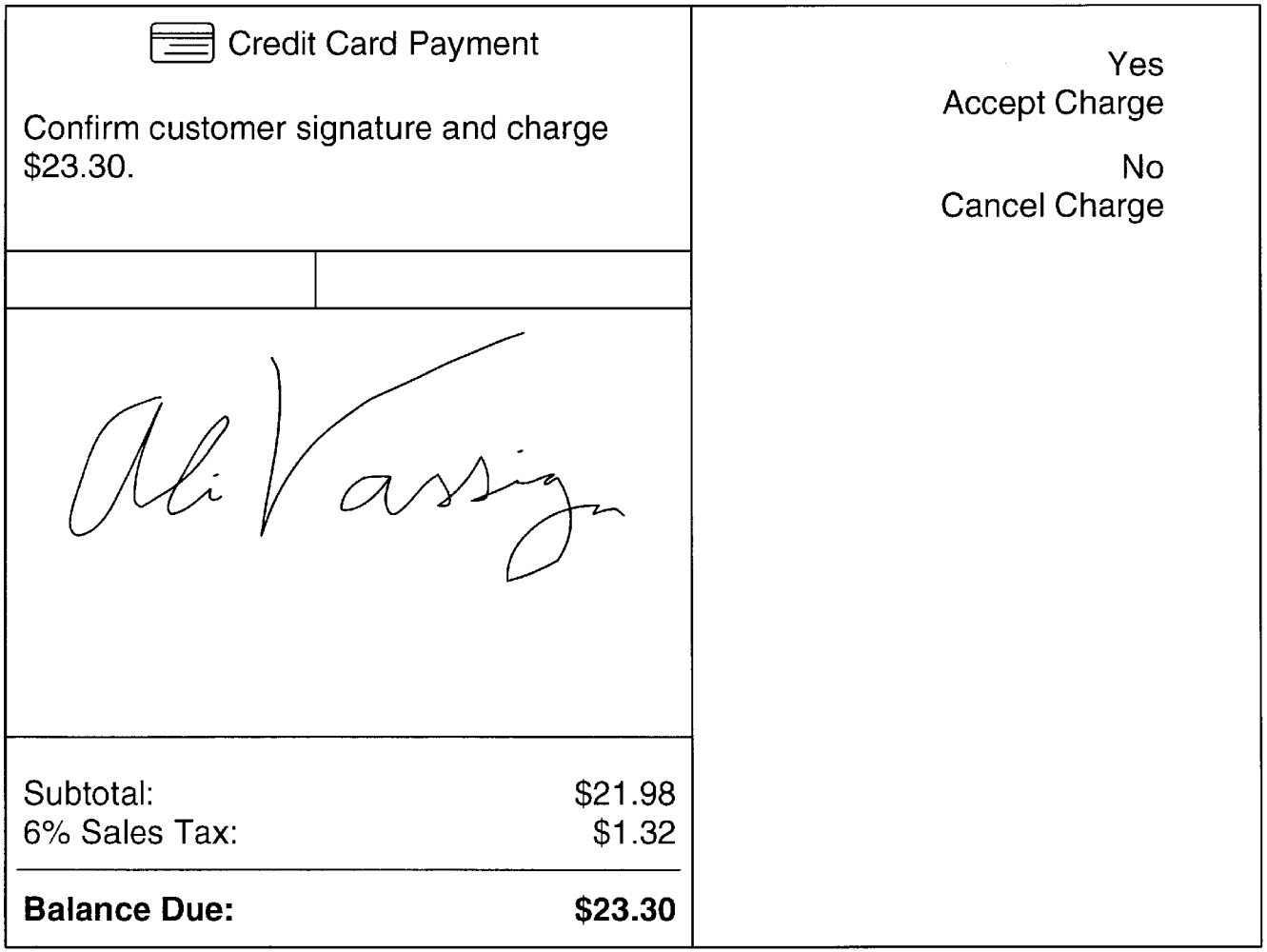
FIG. 18 is a view of another overlay of the choice-driven interface.
Figure 19:
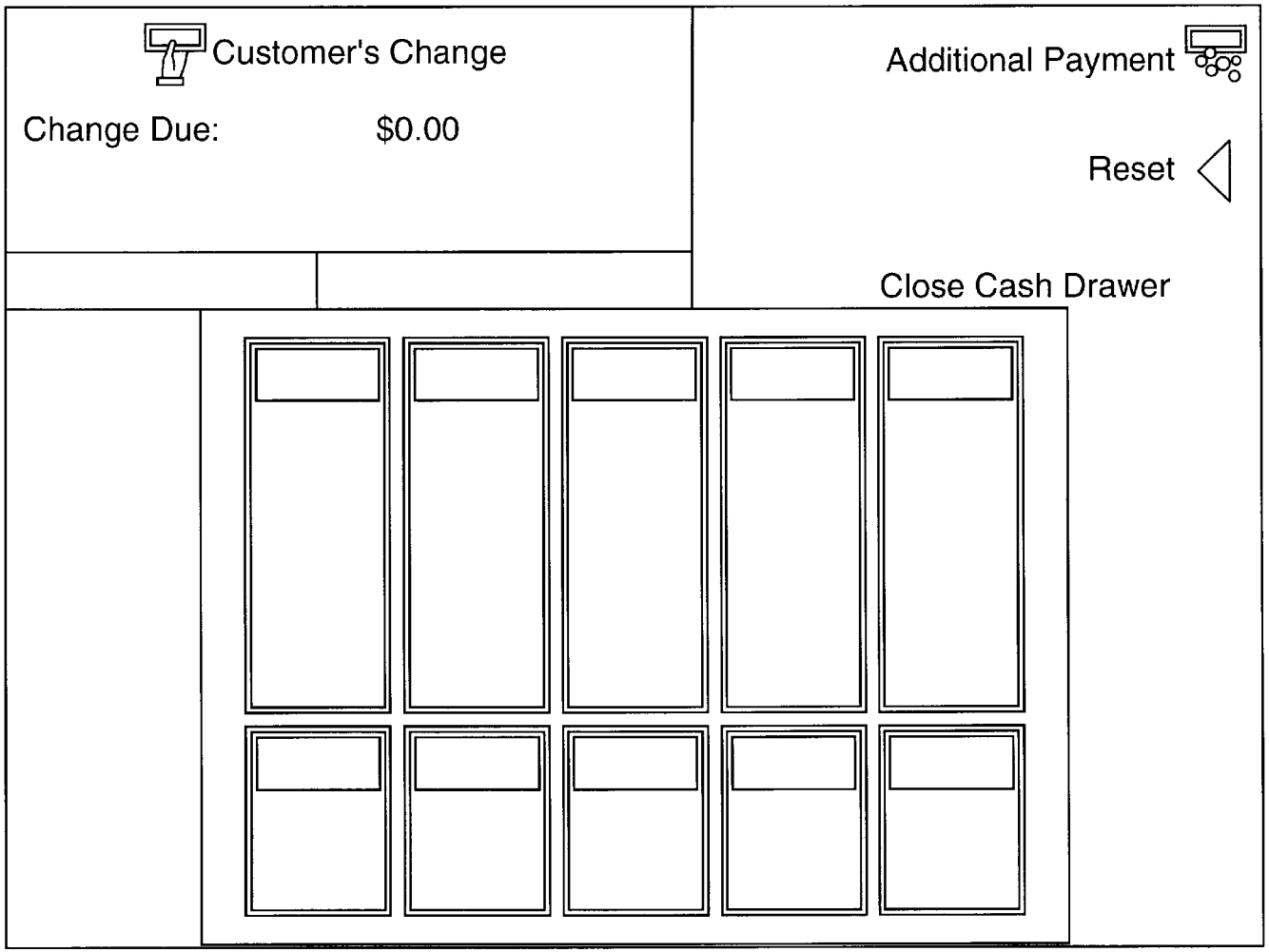
FIG. 19 is a view of another overlay of the choice-driven interface.

In step 82, choice-driven interface application program 28 determines whether any choice other than the exact change choice has been entered by the employee. If so, choice-driven interface application program 28 displays the correct change in terms of paper currency and coins in step 84 (FIG. 16). Advantageously, choice-driven interface application program 28 reduces the chance of employee error in calculating change.

Referring back to step 82, if the exact change choice is entered by the employee, then the method terminates at END 86.

Referring back to step 78, if the payment choice was credit card, then choice-driven interface application program 28 displays an overlay (FIG. 17) for instructing an operator to enter an account number from the credit card in step 79.

In step 81, choice-driven interface application program 28 displays an overlay (FIG. 18) instructing the operator to verify a signature recorded by signature capture device 23.

In step 84, choice-driven interface application program 28 choice-driven interface application program 28 displays a cash drawer indicating that no change is due (FIG. 19), and then terminates at END 86.

Although the present invention has been described with particular reference to certain preferred embodiments thereof, variations and modifications of the present invention can be effected within the spirit and scope of the following claims.

What is claimed is:

1. A method of performing a transaction comprising the steps of:

displaying an item entry overlay for recording a number of purchased merchandise items forming a transaction including a plurality of choice icons which allow the operator to perform operations related to a transaction by a display in a first terminal having a first housing;

recording operator selection of the choice icons by a first keypad in the first terminal; and sending operator selection information recorded by the first keypad to a second terminal which controls the first terminal and which executes a transaction processing application including a graphic user interface including the item entry overlay by the first terminal, the second terminal having a housing different from the first housing of the first terminal.

2. The method as recited in claim 1, wherein the display and first keypad together comprise a touch screen.

3. The method as recited in claim 1, further comprising the steps of:

associating the choice icons with additional overlays of the graphic user interface; and individually displaying the additional overlays by the display upon selection of the choice icons.

4. The method as recited in claim 1, further comprising the step of:

recording information associated with the transaction by a card reader in the first terminal.

5. The method as recited in claim 1, further comprising the step of:

recording information associated with the transaction by a second keypad in the first terminal.

6. The method as recited in claim 5, further comprising the steps of:

recording application of first keys in the first keypad to have the first terminal perform a function a first way; and recording application of second keys in the second keypad to have the first terminal perform the function a second way different from the first way.

7. A method of performing a retail transaction comprising the steps of:

displaying an item entry overlay of a graphic user interface containing a plurality of operator choices by a display in a first terminal having a first housing;

prompting the operator to enter operator selection information indicating entry of any one of the choices through a keypad adjacent the choices;

recording the operator selection information indicating entry of the one choice using the keypad;

sending the operator selection information recorded by the keypad to a second terminal which controls the first terminal and which executes a transaction processing application program including the graphic user interface, the second terminal having a housing different from the first housing of the first terminal; and using the second terminal to cause the first terminal to display an additional overlay of the graphic user interface, the additional overlay being linked to the one choice and containing a plurality of additional operator choices.

8. A method of performing a retail transaction comprising the steps of:

displaying a first overlay of a graphic user interface containing a plurality of item entry choices by a display in a first terminal having a first housing;

using the keypad to record operator selection information indicating entry of one of the choices;

sending the operator selection information recorded by the keypad to a second terminal which controls the first terminal and which executes a processing application program including the graphic user interface, the second terminal having a second housing different from the first housing of the first terminal;

using the second terminal to cause the first terminal to display a second overlay of the graphic user interface, the graphic user interface being linked to the one choice and containing a plurality of payment choices; and using the keypad to record entry of one of the payment choices.

9. The method as recited in claim 8, further comprising the steps of:

displaying a third overlay containing payment amount choices and a total cost;

recording a payment amount choice by the operator through the keypad; and displaying a fourth overlay containing a representation of change information, if the payment amount choice is more than the total cost.

* * * * *